US008756774B2

(12) United States Patent
Rojdev

(10) Patent No.: US 8,756,774 B2
(45) Date of Patent: Jun. 24, 2014

(54) CASKET AND ORNAMENT THEREFORE

(71) Applicant: Batesville Services, Inc., Batesville, IN (US)

(72) Inventor: Ilija Rojdev, Cincinnati, OH (US)

(73) Assignee: Batesville Services, Inc, Batesville, IN (US)

( * ) Notice: Subject to any disclaimer, the term of this patent is extended or adjusted under 35 U.S.C. 154(b) by 0 days.

(21) Appl. No.: 13/948,605

(22) Filed: Jul. 23, 2013

(65) Prior Publication Data

US 2014/0026377 A1 Jan. 30, 2014

Related U.S. Application Data

(60) Provisional application No. 61/675,628, filed on Jul. 25, 2012.

(51) Int. Cl.
*A61G 17/00* (2006.01)

(52) U.S. Cl.
USPC ..... 27/14; 27/19

(58) Field of Classification Search
USPC ..... 27/14–16, 19, 2, 10; 220/376; 40/1.5, 40/124.5, 600, 621; 428/542.4; D99/8, 10, D99/13; 24/303, 90.1, 114.9
See application file for complete search history.

(56) References Cited

U.S. PATENT DOCUMENTS

| | | | | |
|---|---|---|---|---|
| 1,343,280 | A * | 6/1920 | Reynolds | 27/8 |
| 2,659,169 | A * | 11/1953 | Brennan | 40/1.5 |
| 2,712,191 | A * | 7/1955 | Hillenbrand | 428/3 |
| 2,974,389 | A * | 3/1961 | Tatum | 27/1 |
| 3,115,434 | A * | 12/1963 | Hahn | 428/3 |
| 4,222,189 | A * | 9/1980 | Kamei | 40/800 |
| 6,237,202 | B1 * | 5/2001 | Agee et al. | 27/14 |
| 6,393,686 | B1 * | 5/2002 | Braunberger | 29/509 |
| 6,557,222 | B2 | 5/2003 | Groemminger et al. | |
| 6,591,466 | B1 | 7/2003 | Acton et al. | |
| 6,691,385 | B2 | 2/2004 | Bell et al. | |
| 6,723,447 | B1 * | 4/2004 | Braunberger | 428/542.4 |
| 6,883,212 | B2 | 4/2005 | Groemminger et al. | |
| 6,928,706 | B2 | 8/2005 | Acton et al. | |
| 7,210,204 | B2 | 5/2007 | Groemminger et al. | |
| 7,340,810 | B2 | 3/2008 | Acton et al. | |
| 7,591,052 | B2 * | 9/2009 | Bovard et al. | 27/10 |
| 8,387,219 | B2 * | 3/2013 | Rojdev | 27/10 |
| 8,429,840 | B2 * | 4/2013 | Mottola | 40/590 |
| 2005/0155196 | A1 * | 7/2005 | Holzman et al. | 27/14 |
| 2010/0299895 | A1 * | 12/2010 | Burlage et al. | 27/14 |
| 2012/0192390 | A1 * | 8/2012 | Burlage et al. | 27/14 |
| 2012/0266423 | A1 | 10/2012 | Rojdev | |
| 2013/0074299 | A1 * | 3/2013 | Rojdev | 27/14 |

* cited by examiner

*Primary Examiner* — William Miller
(74) *Attorney, Agent, or Firm* — Wood, Herron & Evans, LLP

(57) ABSTRACT

A casket comprises a casket shell adapted to receive the remains of a deceased having a pair of side walls, a pair of end walls, and a bottom wall, and a casket cap closable on the casket shell. A dish assembly is mounted to an underside of the cap. The dish assembly includes a cap panel comprising a sheet of magnetic material. At least one medallion having text and/or graphics representing a life aspect of the deceased is removably mounted on the cap panel. The medallion comprises a medallion blank having at least one magnet on a rear side thereof and having a recess on a front side thereof, a two-dimensional image positioned in the recess of the medallion blank, and a transparent layer of material overlying the two-dimensional image. The transparent layer of material is dome-shaped in cross section such that a peripheral outer edge of the layer is thinner than a central portion of the layer. The magnet removably secures the medallion blank to the magnetic material of the cap panel.

26 Claims, 7 Drawing Sheets

CASKET AND ORNAMENT THEREFORE

RELATED APPLICATIONS

This application claims the priority benefit of U.S. Provisional Patent Application No. 61/675,628 filed Jul. 25, 2012, which is hereby incorporated by reference herein as if fully set forth in its entirety.

FIELD OF THE INVENTION

This invention relates generally to caskets, and more particularly to caskets having personalization/memorialization features such as casket ornaments and to casket ornament constructions.

BACKGROUND OF THE INVENTION

When an individual passes away it is customary for the body of the individual to be viewed by family and friends at a funeral home. After the viewing, a funeral or other memorial service is generally held at the funeral home or a church to commemorate the life of the deceased. Thereafter, a grave side service may be held with family and friends looking on. With the completion of the grave side service the casket is lowered into the grave where it will remain. A similar service may be held prior to or after the deceased is cremated. Usually after cremation the cremated remains are collected and presented to the family in a cremation urn.

The casket in which the deceased is displayed can be customized to fit the needs and preferences of the deceased and the family. For instance, a wide variety of materials, finishes, colors and decorative ornamentation can be chosen to meet these needs. The purchaser of a casket can also customize the casket using a variety of interchangeable stylized trim, for example, corner ornaments. The purchaser may select from a number of stylized corner ornaments each of which has been ornamented to represent a "theme." The purchaser thus selects a corner ornament design having a theme representative of an aspect of the deceased's life to personalize the casket, for example, a golf corner ornament design could be selected for installation on the casket to reflect that the deceased was an avid golfer.

Once the casket is buried or the deceased is cremated and the funeral or other memorial service is completed, the families are left with few tangible reminders of the funeral or memorial service. Most families receive flowers at the funeral home which pay respect to the deceased and his or her surviving family. These flowers, however, wilt and die after a short time, leaving the family with few remembrances of the funeral or memorial service. It is desirable for the families to receive a more tangible and permanent reminder of the funeral or memorial service.

Prior solutions to this need may be seen in the quick change casket ornament of the assignee's U.S. Pat. Nos. 7,340,810, 6,928,706, and 6,591,466, which may be removed from the casket and mounted on either the plaque of the assignee's U.S. Pat. Nos. 7,210,204, 6,883,212, and 6,557,222 or the pedestal of the assignee's U.S. Pat. No. 6,691,385 and presented to a family member or loved one of the deceased. All of these patents are hereby incorporated by reference herein as if fully set forth in their entirety.

Another more recent solution to this need may be seen with reference to the assignee's U.S. patent application Ser. No. 12/605,073 for Memorial Casket and Method and published as US Patent Application Publication No. 2010/0299895 on Dec. 2, 2010, hereby incorporated by reference herein as if fully set forth in its entirety. In this application there is disclosed a casket comprising a casket shell adapted to receive the remains of a deceased and having a pair of side walls, a pair of end walls, and a bottom wall, a casket cap closable on the casket shell, and at least one medallion mounted on either an interior surface or an exterior surface of either the cap or the shell, the medallion having text and/or graphics representing a life aspect of the deceased. In one embodiment, the cap includes a dish assembly mounted to an underside of the cap. The dish assembly includes a cap panel comprising a sheet of magnetic material. The medallion has a magnet on a rear side thereof that allows the medallion to be mounted on the cap panel in any desired position.

A typical medallion of the type used with the casket of application Ser. No. 12/605,073 is on the order of about 4.25 inches in diameter and is cast in a die from pewter or aluminum. The die includes a three-dimensional image of the desired life aspect of the deceased; that three-dimensional image is cast into the medallion during the casting process. Once the medallion has been cast and removed from the die, the three-dimensional image of the medallion is hand-painted.

While the type of casket medallion of application Ser. No. 12/605,073 has met with success, the production process of this type of medallion is expensive, tedious, and time consuming. Each different life aspect image requires a separate die. The dies can be expensive, and each die can take weeks to produce. Depending on the popularity of a particular life aspect image, its respective die may only be used a few times to produce only a few medallions, thus driving up the cost per medallion for that particular life aspect image. Each medallion, once cast, must have its three-dimensional image hand painted, which is tedious and time consuming.

Another even more recent solution to this need may be seen with reference to the assignee's U.S. patent application Ser. No. 13/242,594 filed Sep. 23, 2011 for Casket And Ornament Therefore and published as US Patent Application Publication No. 2013/0074299 on Mar. 28, 2013, hereby incorporated by reference herein as if fully set forth in its entirety. In this application there is disclosed a casket comprising a casket shell adapted to receive the remains of a deceased and having a pair of side walls, a pair of end walls, and a bottom wall, and a casket cap closable on the casket shell. A dish assembly is mounted to an underside of the cap. The dish assembly includes a cap panel comprising a sheet of magnetic material. At least one medallion having text and/or graphics representing a life aspect of the deceased is removably mounted on the cap panel. The medallion comprises a medallion blank having at least one magnet on a rear side thereof and having a recess on a front side thereof, and a button removably received in the recess of the medallion blank. The button comprises a button front, a magnetic metallic button back, and a two-dimensional image overlying an upper surface of the button front. The magnet removably secures the medallion blank to the magnetic material of the cap panel, while at the same time securing the button in the recess of the medallion blank.

The medallion of the type used with the casket of U.S. patent application Ser. No. 13/242,594 provides a number of advantages. Only a single medallion die is required—one for the medallion blank. Only a single type of medallion need be kept in stock by the funeral director—the medallion blank. The funeral director has the capability to make custom medallions onsite at the time of service. A family member need only provide the funeral director with a photo, and the funeral director can assemble onsite a button with commercially available button producing apparatus (or snap together button parts) that displays the photo. The button is then installed into the medallion blank, and the fully assembled medallion is then installed on the casket. Multiple expensive medallion dies, each taking weeks to produce, are no longer required. Tedious and time consuming hand painting of three-dimensional medallions is no longer required.

While the type of casket medallion of application Ser. No. 13/242,594 has met with success, it would be desirable to combine the higher quality "look and feel" of the casket medallion of application Ser. No. 12/605,073 with the ability to make custom casket medallions on site at the time of service per application Ser. No. 13/242,594.

SUMMARY OF THE INVENTION

In one aspect, a casket comprises a casket shell adapted to receive the remains of a deceased having a pair of side walls, a pair of end walls, and a bottom wall, and a casket cap closable on the casket shell. A dish assembly is mounted to an underside of the cap. The dish assembly includes a cap panel comprising a sheet of magnetic material. At least one medallion having text and/or graphics representing a life aspect of the deceased is removably mounted on the cap panel. The medallion comprises a medallion blank having at least one magnet on a rear side thereof and having a recess on a front side thereof, a two-dimensional image positioned in the recess of the medallion blank, and a transparent layer of material overlying the two-dimensional image. The transparent layer of material is dome-shaped in cross section such that a peripheral outer edge of the layer is thinner than a central portion of the layer. The magnet removably secures the medallion blank to the magnetic material of the cap panel.

The transparent layer of material can be either a prefabricated adhesively-backed transparent sheet adhesively secured to the medallion blank or transparent UV cured liquid. The medallion blank can be circular as can the recess in the medallion blank. The medallion blank can further include a circumferential groove between a periphery of the recess and a periphery of the medallion blank. The two-dimensional image can be printed on adhesively-backed film adhesively secured to medallion blank.

In another aspect, a method of personalizing such a casket comprises providing a medallion blank having at least one magnet on a rear side thereof and having a recess on a front side thereof, positioning a two-dimensional image in the recess of the medallion blank, positioning a transparent layer of material so as to overlie the two-dimensional image, the transparent layer of material being dome-shaped in cross section such that a peripheral outer edge of the layer is thinner than a central portion of the layer, and removably securing the medallion blank to the magnetic material of the cap panel via the at least one magnet.

The step of positioning the transparent layer of material so as to overlie the two-dimensional image can comprise adhesively attaching a prefabricated sheet of the transparent material to the medallion, or pouring a transparent UV curable liquid over the two-dimensional image and into the recess and then UV curing the liquid. The method can further comprise printing the two-dimensional image on adhesively-backed film, die-cutting the film with image thereon to the correct size, and adhering the die-cut adhesively-backed film with image thereon to the medallion blank.

In another aspect, a method of personalizing a casket to a deceased comprises, subsequent to the death of the deceased and prior to a funeral or other memorial service for the deceased, receiving a selection of a two-dimensional image from a loved one of the deceased of significance to at least one of the loved one and the deceased, attaching the two-dimensional image directly to a medallion blank and beneath a layer of transparent material, and securing the medallion blank to a cap panel of the casket.

The layer of transparent material can be dome-shaped in cross section such that a peripheral outer edge of the layer is thinner than a central portion of the layer.

The step of attaching the two-dimensional image to the medallion blank and beneath the layer of transparent material can comprise adhesively attaching the two-dimensional image to the medallion blank and adhesively attaching a prefabricated sheet of the transparent material to the two-dimensional image. The step of attaching the two-dimensional image to the medallion blank and beneath the layer of transparent material can also comprise adhesively attaching the two-dimensional image to the medallion blank and pouring a transparent UV curable liquid over the two-dimensional image and onto the medallion blank and then UV curing the liquid. The step of securing the medallion blank to the cap panel can comprise magnetically securing the medallion blank to the cap panel. The method can further comprise printing the two-dimensional image on adhesively-backed film, die-cutting the film with image thereon to the correct size, and adhering the die-cut adhesively-backed film with image thereon to the medallion blank.

The casket and ornament of this invention provide a number of advantages. Only a single medallion die is required—one for the medallion blank. Only a single type of medallion need be kept in stock by the funeral director—the medallion blank. The funeral director has the capability to make custom medallions onsite at the time of the funeral or other memorial service. A family member need only select and provide the funeral director with a photo, artwork, etc. (or select one from the funeral director) and the funeral director can assemble onsite a medallion using the medallion blank, the selected image, and commercially available transparent sheet material. The assembled medallion can then be installed in/on the casket. Multiple expensive medallion dies, each taking weeks to produce, are no longer required. Tedious and time consuming hand painting of three-dimensional medallions is no longer required. At the same time, the resulting product is more permanent, has a higher quality, and is of greater value to the family than the button-type medallion.

DETAILED DESCRIPTION OF THE DRAWINGS

Figure 1:
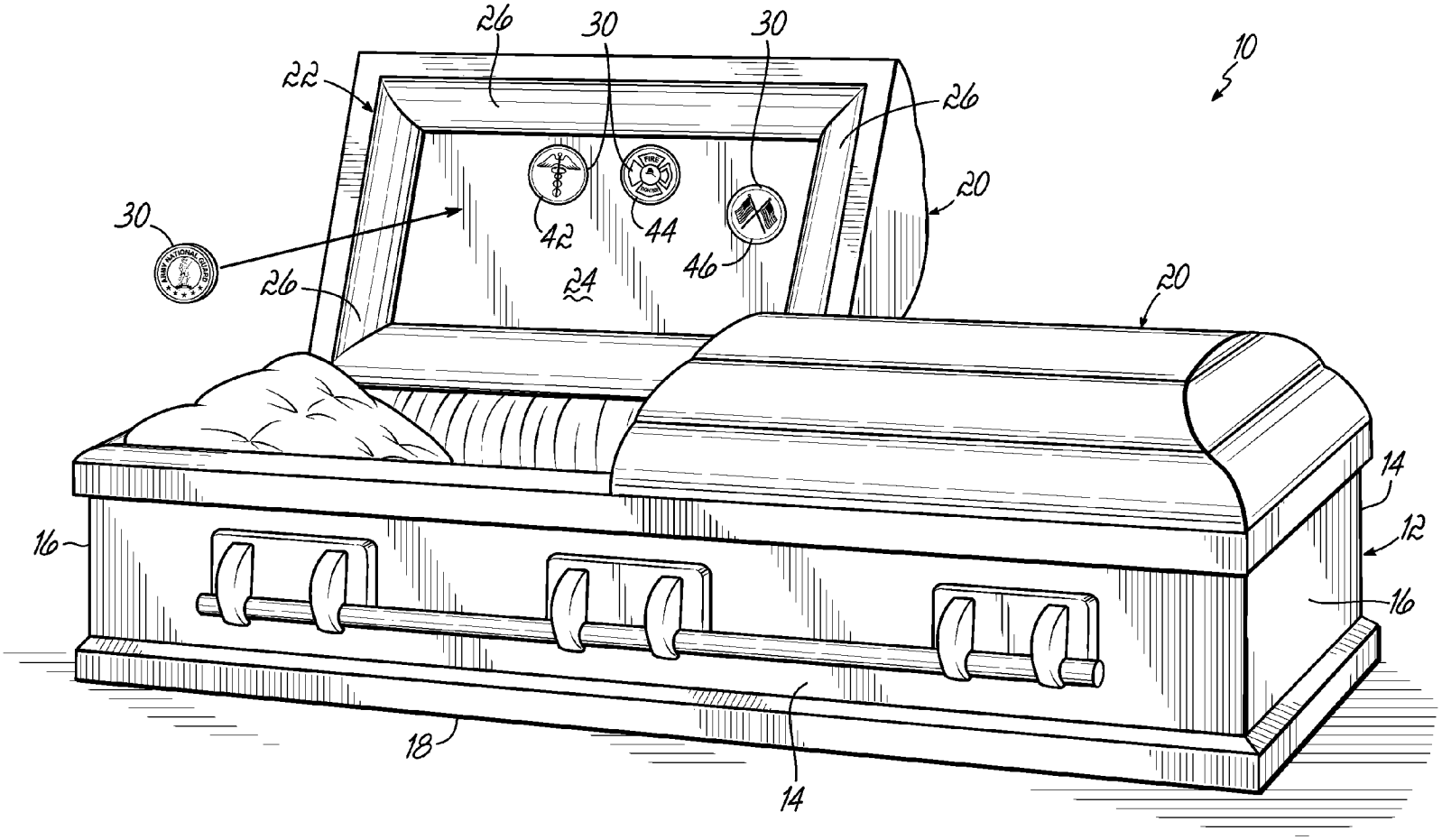
FIG. 1 is a perspective view of a casket according to the principles of the invention.

Referring to FIG. 1, a casket 10 has a shell 12 adapted to receive the remains of a deceased having a pair of side walls 14, 14, a pair of end walls 16, 16, and a bottom wall 18, and a cap 20 closable on the shell 12. The casket may have a pair of caps or a single cap the full length of the casket. Cap 20 has an ornamental dish assembly 22 mounted to an underside of the cap 20. The dish assembly 22 includes a cap panel 24 and may include ornamental puffing members 26 mounted around a periphery of the dish assembly 22. One or more medallions 30 are mounted to the cap panel 24 of the dish assembly 22. The medallion 30 has text and/or graphics representing a life aspect of the deceased, for example, Father, Brother, Husband, Lawyer, Christian, Hunter, Fisherman, etc.

Figure 2:
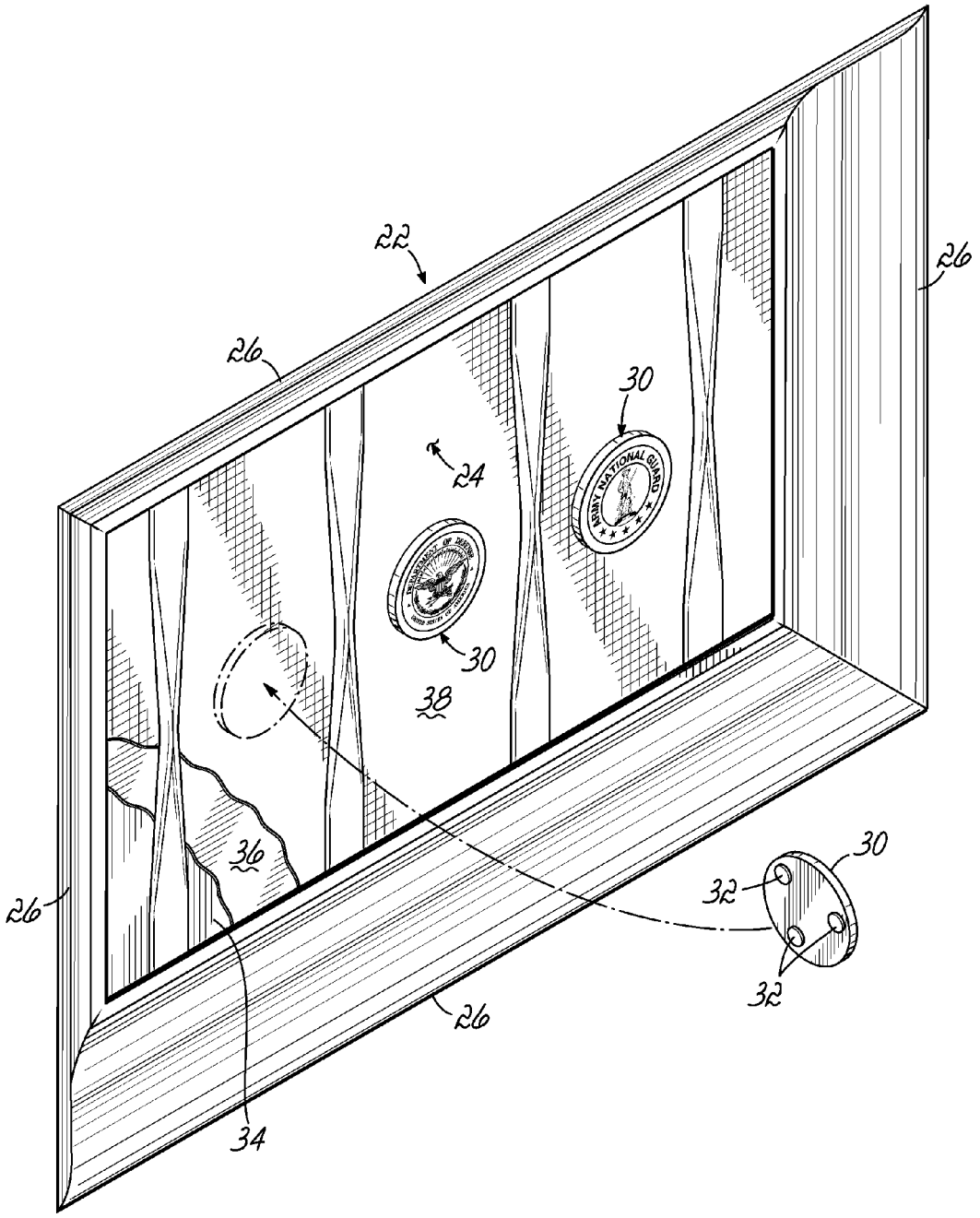
FIG. 2 is a perspective view of the casket cap dish assembly and medallions.
Figure 3:
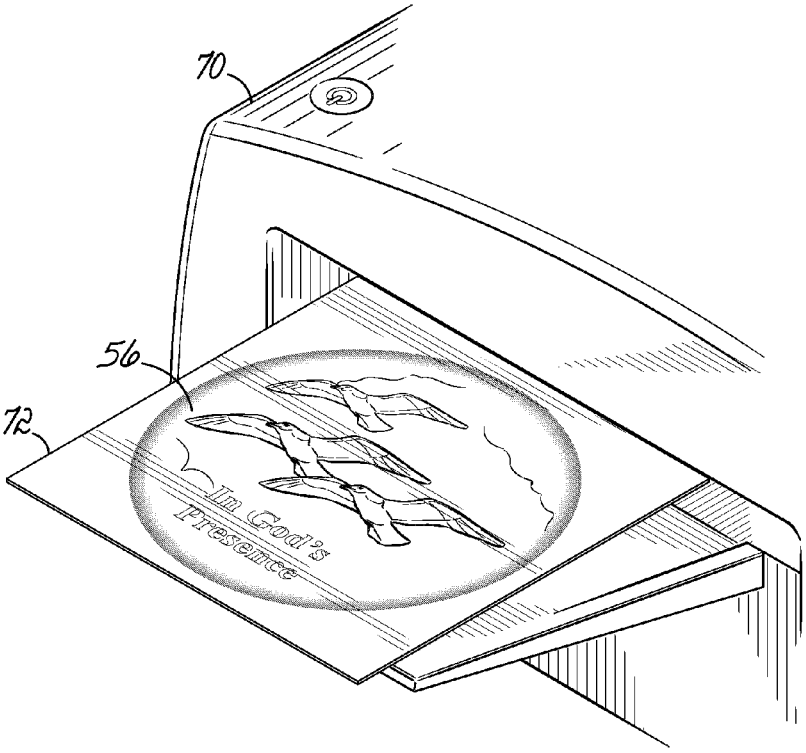
FIGS. 3-6 illustrate steps that can be employed in the production of the medallion.
Figure 4:
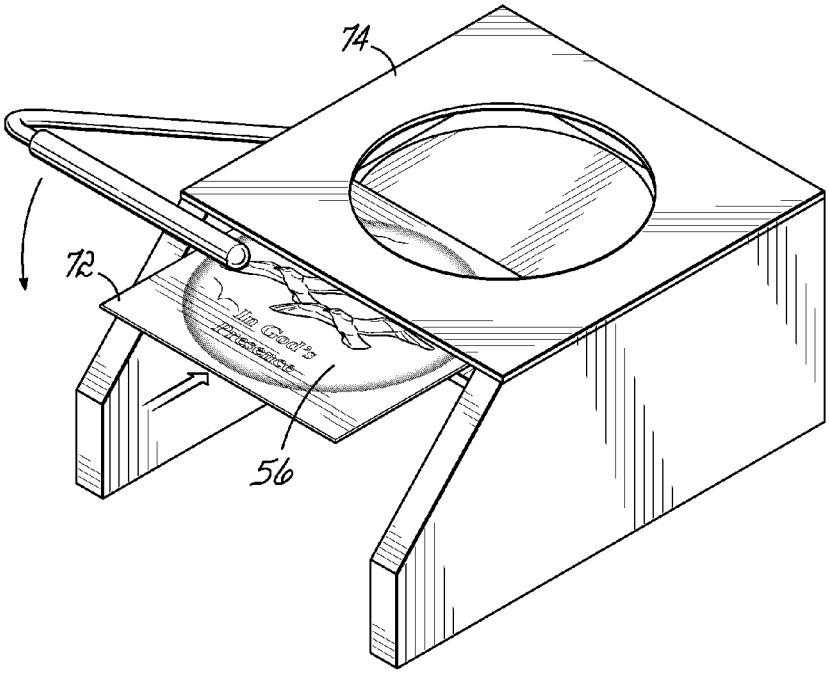
Figure 5:
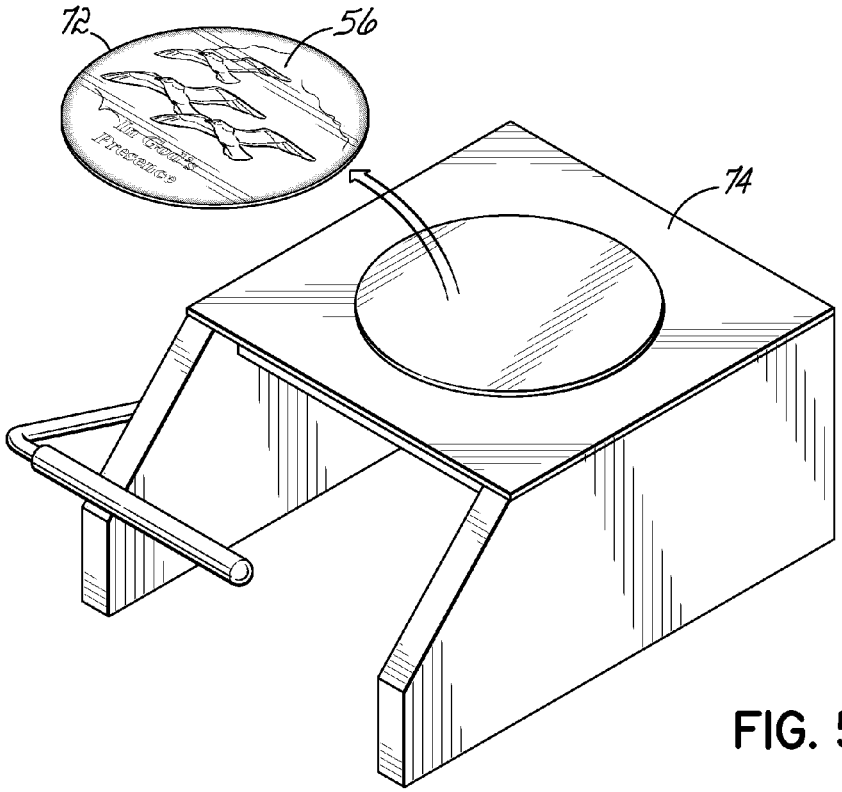
Figure 6:
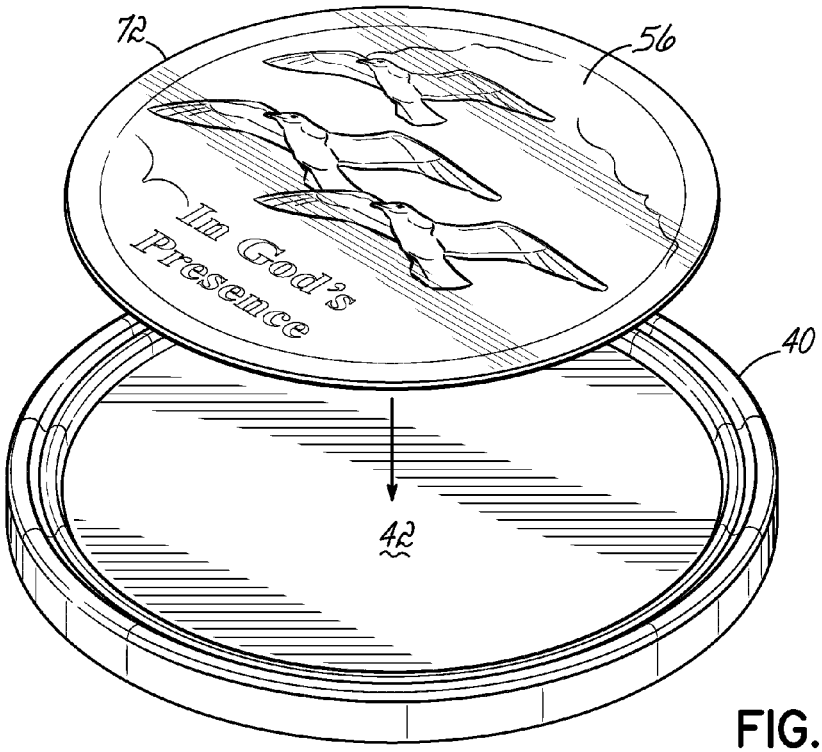
Figure 7:
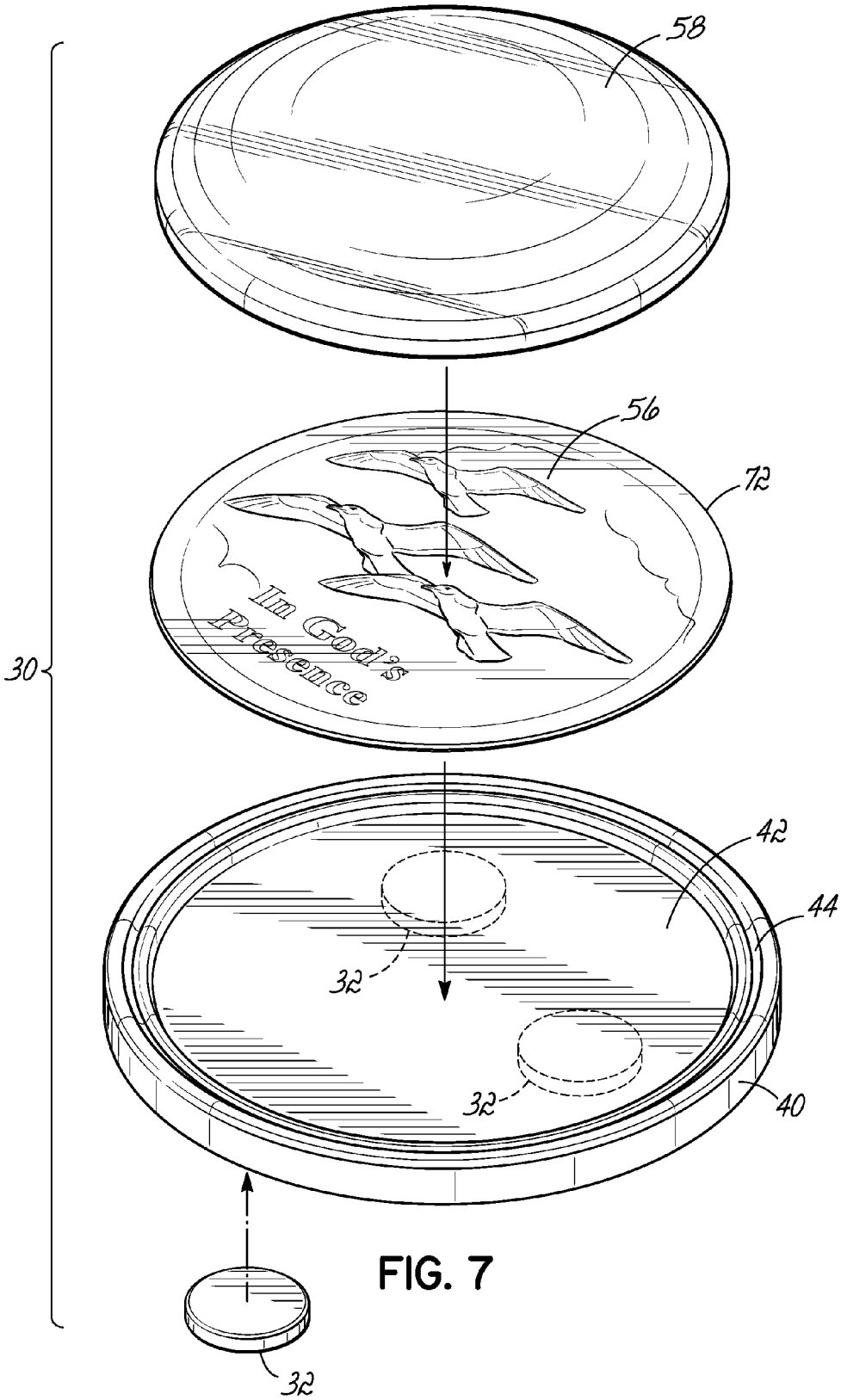
FIG. 7 is an exploded perspective view of the medallion.
Figure 8:
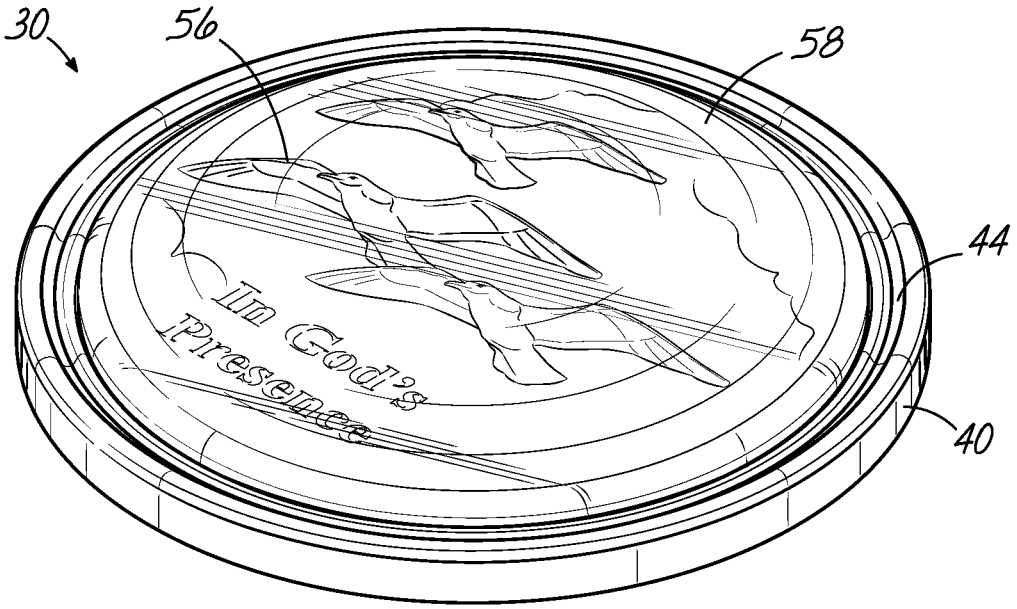
FIG. 8 is an assembled perspective view of the medallion.
Figure 9A:
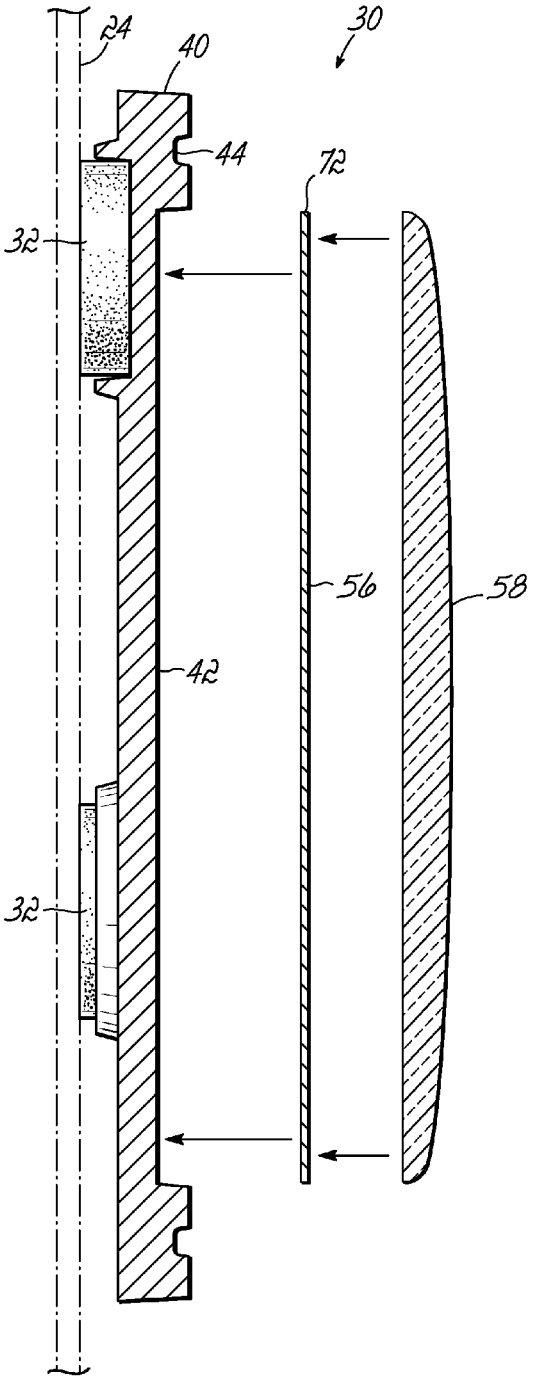
FIG. 9A is an exploded cross-sectional view of the medallion of FIG. 7.
Figure 9B:
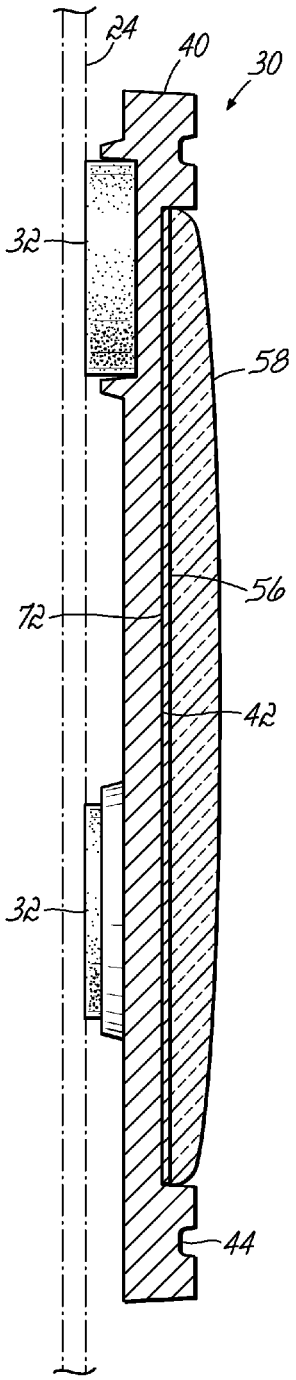
FIG. 9B is an assembled cross-sectional view of the medallion of FIG. 8.

Referring to FIG. 2, the dish assembly 22 is constructed in such a way as to permit medallions 30 to be placed anywhere on the cap panel 24. More particularly, each medallion 30 has one or more magnets 32 secured on a rear side thereof, for example permanently secured in recesses on/in the rear side thereof with adhesives or the like. Acceptable magnets 32 are neodymium magnets, for example the model ND007509N available from Master Magnetics, Inc., Castle Rock, Colo., www.magnetsource.com. The cap panel 24 is fabricated from a sheet of cardboard or chipboard 34 over which is placed a sheet of magnetic material 36, for example steel. The sheet of magnetic material 36 is then covered with a sheet of decorative material 38. Since the entire surface area of the cap panel 24 is magnetic material, medallions 30 can be placed anywhere within the surface area of the cap panel 24. This permits more freedom in placing and arranging medallions as desired by the funeral director and family, friends, and loved ones of the deceased.

Referring to FIGS. 7-9B, the medallion 30 comprises a medallion blank 40, a two-dimensional image 56, and a transparent layer of material 58. Like the medallion of US Patent Application Publication No. 2010/0299895 and the medallion blank of US Patent Application Publication No. 2013/0074299, medallion blank 40 can be fabricated of metallic material, for example die cast pewter or aluminum, or non-metallic material, with a diameter of about 4.25 inches. Medallion blank 40 has a recess 42 on a front side thereof for receiving the two-dimensional image 56 and the transparent sheet of material 58, as will be described below. Preferably, the medallion blank 40 and the recess 42 therein are circular, as is the two-dimensional image 56. The medallion blank 40 can further include a one or more decorative circumferential grooves 44 positioned radially between a periphery of the recess 42 and a periphery of the medallion blank 40.

Referring to FIGS. 3-6, the two-dimensional image 56 is received in the recess 42 of the medallion blank 40. The two-dimensional image 56 can be, for example, a photograph, clip art or other artwork, etc. For example, the photo or artwork can be printed with the use of a conventional computer printer 70 by printing the image (previously uploaded to the computer) onto an adhesively-backed substrate such as paper or film 72, and the adhesively-backed substrate 72 with image 56 thereon can then be die-cut to the correct size with a die-cut apparatus 74. The image can then be adhered into the recess 42 of the medallion blank 40.

Finally, the transparent layer of material 58 is positioned over and adhered to the two-dimensional image 56 to protect it and enhance the appearance of the medallion 30.

The transparent layer of material 58 can be, for example, a prefabricated adhesively-backed sheet, or UV cured (ultraviolet light cured) liquid. In either instance, the transparent layer of material 58 is preferably dome-shaped in cross section such that a peripheral outer edge of the layer of material 58 is thinner than a central portion of the layer of material 58, and is thus a clear dome. This provides good protection to the photograph or artwork as well as an aesthetically pleasing appearance. As another example, transparent layer of material 58 could be fabricated of a two part epoxy.

One acceptable and commercially available adhesively-backed film substrate upon which to print the image is 1090 White Vinyl, a topcoated flexible white vinyl film coated with a permanent pressure sensitive modified acrylic adhesive and backed with a two-side poly coated lay flat release liner, available from Dome Labels of Las Vegas, Nev., www.dome-labels.com.

One acceptable and commercially available material from which to manufacture clear domes is Z8500 clear polyurethane compound, a clear two-part polyurethane compound also available from Dome Labels.

One acceptable and commercially available material for adhering prefabricated clear domes to the white vinyl film substrate upon which the image is printed is FLEXMARK® V 200 Clear V-755 400 Poly H-9, a clear vinyl film coated with a permanent pressure sensitive acrylic adhesive and backed with a clear ultra smooth polyester release liner, available from Flexcon Company, Inc. of Spencer, Mass., www.flexcon.com.

Dome Labels can supply a funeral director or casket manufacturer with just prefabricated adhesively-backed clear circular domes of these materials. Alternatively, the funeral director or casket manufacturer can supply Dome Labels with selected images and Dome Labels can fabricate and supply to the funeral director or casket manufacture an assembled product comprised of circular adhesively-backed white vinyl with the funeral director/casket manufacturer selected image printed thereon and covered by a clear circular dome of these materials.

One acceptable and commercially available UV cured liquid from which to manufacture the clear domes is UltraDome UV epoxy, a UV cured epoxy, available from Terry Morris Productions of Carlsbad, Calif., www.tmpro.com. The UV cured liquid also exhibits a domed appearance due to the surface tension of the liquid once poured into the recess 42.

In use, a funeral director need only keep medallion blanks in stock, rather than various designs of medallions (of which there are only a finite number). The funeral director can purchase and keep on hand a supply of the prefabricated adhesively-backed clear domes and adhesively-backed white vinyl. Alternatively the funeral director could purchase and keep on hand UV cured liquid and a UV curing machine. Friends, family, and other loved ones of the deceased can provide the funeral director with two-dimensional images such as photos, clip art, other artwork, etc., and the funeral director can make custom medallions within a matter of minutes with medallion blanks, the provided images, and the prefabricated clear domes or UV cured liquid. The medallions can then be removably placed on the cap panel of the dish assembly mounted in the underside of the casket lid.

Alternatively, the family members could select from pre-assembled product purchased and kept on hand by the funeral director comprised of circular adhesively-backed white vinyl with the funeral director/casket manufacturer selected images printed thereon and covered by a clear circular dome.

The embodiments shown and described are merely for illustrative purposes only. The drawings and the description are not intended to limit in any way the scope of the claims. Those skilled in the art will appreciate various changes, modifications, and other embodiments. For example, the medallion disclosed herein can be mounted on cremation urns as well as caskets. It can be presented to a friend, family member, or loved one of the deceased as a keepsake. All such changes, modifications and embodiments are deemed to be embraced by the claims. Accordingly, the scope of the right to exclude shall be limited only by the following claims and their equivalents.

What is claimed is:

1. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, said cap panel comprising a sheet of magnetic material, and at least one medallion removably mounted on said cap panel, said medallion having at least one of text and graphics representing a life aspect of the deceased, wherein said medallion comprises:

a medallion blank having at least one magnet on a rear side thereof and having a recess on a front side thereof, a two-dimensional image positioned in said recess of said medallion blank, and a transparent layer of material overlying said two-dimensional image, said transparent layer of material being dome-shaped in cross section such that a peripheral outer edge of said layer is thinner than a central portion of said layer, said at least one magnet removably securing said medallion blank to said magnetic material of said cap panel.

2. The casket of claim 1 wherein said transparent layer of material is a prefabricated adhesively-backed sheet adhesively secured to said medallion blank.

3. The casket of claim 1 wherein said transparent layer of material is formed from UV cured liquid.

4. The casket of 1 wherein said medallion blank is circular and said recess in said medallion blank is circular.

5. The casket of claim 4 wherein said medallion blank further includes a circumferential groove between a periphery of said recess and a periphery of said medallion blank.

6. The casket of claim 1 wherein said two-dimensional image is printed on adhesively-backed film that is adhesively secured to said medallion blank.

7. The casket of claim 1 wherein said transparent layer of material is formed from a two part epoxy.

8. A method of personalizing a casket, the casket comprising a casket shell adapted to receive the remains of a deceased having a pair of side walls, a pair of end walls, and a bottom wall, and a casket cap closable on the casket shell, the cap including a dish assembly mounted to an underside thereof, the dish assembly including a cap panel, the cap panel comprising a sheet of magnetic material, the method comprising the steps of:

providing a medallion blank having at least one magnet on a rear side thereof and having a recess on a front side thereof, positioning a two-dimensional image in the recess of the medallion blank, positioning a transparent layer of material so as to overlie the two-dimensional image, the transparent layer of material being dome-shaped in cross section such that a peripheral outer edge of the layer is thinner than a central portion of the layer, and removably securing the medallion blank to the magnetic material of the cap panel via the at least one magnet on the rear side of the medallion blank.

9. The method of claim 8 wherein the step of positioning a transparent layer of material so as to overlie the two-dimensional image comprises adhesively attaching a prefabricated sheet of the transparent material to the medallion.

10. The method of claim 8 wherein the step of positioning a transparent layer of material so as to overlie the two-dimensional image comprises pouring a transparent UV curable liquid over the two-dimensional image and into the recess and then UV curing the liquid.

11. The method of 8 wherein the medallion blank is circular and the recess in the medallion blank is circular.

12. The method of claim 11 wherein the medallion blank further includes a circumferential groove between a periphery of the recess and a periphery of the medallion blank.

13. The method of claim 8 further comprising the steps of:

printing the two-dimensional image on adhesively-backed film, die-cutting the film with image thereon to the correct size, and adhering the die-cut adhesively-backed film with image thereon to the medallion blank.

14. The method of claim 8 wherein the step of positioning a transparent layer of material so as to overlie the two-dimensional image comprises applying a two part epoxy over the two-dimensional image and then allowing the epoxy to cure.

15. A method of personalizing a casket to a deceased, the casket comprising a casket shell adapted to receive the remains of the deceased and having a pair of side walls, a pair of end walls, and a bottom wall, and a casket cap closable on the casket shell, the cap including a dish assembly mounted to an underside thereof, the dish assembly including a cap panel, the method comprising the steps of:

subsequent to the death of the deceased and prior to a funeral or other memorial service for the deceased, receiving a selection of a two-dimensional image from a loved one of the deceased of significance to at least one of the loved one and the deceased, providing a medallion blank being formed as a unitary body and having a recess on a front side thereof, placing the two-dimensional image directly against a bottom surface of the recess, applying a layer of transparent material over the two-dimensional image, and securing the assembled medallion blank and two-dimensional image to the cap panel.

16. The method of claim 15 wherein the step of securing the medallion blank to the cap panel comprises magnetically securing the medallion blank to the cap panel via cooperation between at least one magnet and a magnetic material.

17. The method of claim 15 wherein the two-dimensional image has a source, and wherein the source of the two-dimensional image is adapted to be the deceased or the loved one.

18. The method of claim 15 wherein the two-dimensional image has a source, and wherein the source of the two-dimensional image is adapted to be other than the deceased or the loved one.

19. The method of claim 15 wherein the two-dimensional image is adhered to the medallion blank.

20. The method of claim 15 wherein the transparent material is a sheet adhered to the two-dimensional image.

21. The method of claim 15 wherein the transparent material is a liquid poured over the two-dimensional image and cured into a solid.

22. A method of personalizing a casket to a deceased, the casket comprising a casket shell adapted to receive the remains of the deceased and having a pair of side walls, a pair of end walls, and a bottom wall, and a casket cap closable on the casket shell, the cap including a dish assembly mounted to an underside thereof, the dish assembly including a cap panel, the method comprising the steps of:

subsequent to the death of the deceased and prior to a funeral or other memorial service for the deceased, receiving a selection of a two-dimensional image from a loved one of the deceased of significance to at least one of the loved one and the deceased, attaching the two-dimensional image directly to a medallion blank and beneath a layer of transparent material, and securing the medallion blank to the cap panel, wherein the layer of transparent material is dome-shaped in cross section such that a peripheral outer edge of the layer is thinner than a central portion of the layer.

23. A method of personalizing a casket to a deceased, the casket comprising a casket shell adapted to receive the remains of the deceased and having a pair of side walls, a pair of end walls, and a bottom wall, and a casket cap closable on the casket shell, the cap including a dish assembly mounted to an underside thereof, the dish assembly including a cap panel, the method comprising the steps of:

subsequent to the death of the deceased and prior to a funeral or other memorial service for the deceased, receiving a selection of a two-dimensional image from a loved one of the deceased of significance to at least one of the loved one and the deceased, attaching the two-dimensional image directly to a medallion blank and beneath a layer of transparent material, and securing the medallion blank to the cap panel, wherein the step of attaching the two-dimensional image to the medallion blank and beneath the layer of transparent material comprises adhesively attaching the two-dimensional image to the medallion blank and adhesively attaching a prefabricated sheet of the transparent material to the two-dimensional image.

24. A method of personalizing a casket to a deceased, the casket comprising a casket shell adapted to receive the remains of the deceased and having a pair of side walls, a pair of end walls, and a bottom wall, and a casket cap closable on the casket shell, the cap including a dish assembly mounted to an underside thereof, the dish assembly including a cap panel, the method comprising the steps of:

subsequent to the death of the deceased and prior to a funeral or other memorial service for the deceased, receiving a selection of a two-dimensional image from a loved one of the deceased of significance to at least one of the loved one and the deceased, attaching the two-dimensional image directly to a medallion blank and beneath a layer of transparent material, and securing the medallion blank to the cap panel, wherein the step of attaching the two-dimensional image to the medallion blank and beneath the layer of transparent material comprises adhesively attaching the two-dimensional image to the medallion blank and pouring a transparent UV curable liquid over the two-dimensional image and onto the medallion blank and then UV curing the liquid.

25. A method of personalizing a casket to a deceased, the casket comprising a casket shell adapted to receive the remains of the deceased and having a pair of side walls, a pair of end walls, and a bottom wall, and a casket cap closable on the casket shell, the cap including a dish assembly mounted to an underside thereof, the dish assembly including a cap panel, the method comprising the steps of:

subsequent to the death of the deceased and prior to a funeral or other memorial service for the deceased, receiving a selection of a two-dimensional image from a loved one of the deceased of significance to at least one of the loved one and the deceased, attaching the two-dimensional image directly to a medallion blank and beneath a layer of transparent material, and securing the medallion blank to the cap panel, further comprising the steps of:

printing the two-dimensional image on adhesively-backed film, die-cutting the film with image thereon to the correct size, and adhering the die-cut adhesively-backed film with image thereon to the medallion blank.

26. A method of personalizing a casket to a deceased, the casket comprising a casket shell adapted to receive the remains of the deceased and having a pair of side walls, a pair of end walls, and a bottom wall, and a casket cap closable on the casket shell, the cap including a dish assembly mounted to an underside thereof, the dish assembly including a cap panel, the method comprising the steps of:

subsequent to the death of the deceased and prior to a funeral or other memorial service for the deceased, receiving a selection of a two-dimensional image from a loved one of the deceased of significance to at least one of the loved one and the deceased, attaching the two-dimensional image directly to a medallion blank and beneath a layer of transparent material, and securing the medallion blank to the cap panel, wherein the step of attaching the two-dimensional image to the medallion blank and beneath the layer of transparent material comprises adhesively attaching the two-dimensional image to the medallion blank and applying a two part epoxy over the two-dimensional image and onto the medallion blank and then allowing the epoxy to cure.

* * * * *